US006386465B1

(12) United States Patent
Wilson

(10) Patent No.: US 6,386,465 B1
(45) Date of Patent: May 14, 2002

(54) GUN

(75) Inventor: Mark Stephen Wilson, Brisbane (AU)

(73) Assignee: ABW Australia Pty. Ltd., Brisbane (AU)

( * ) Notice: Subject to any disclaimer, the term of this patent is extended or adjusted under 35 U.S.C. 154(b) by 0 days.

(21) Appl. No.: 09/509,561

(22) PCT Filed: Oct. 5, 1998

(86) PCT No.: PCT/AU98/00827

§ 371 Date: Apr. 17, 2000

§ 102(e) Date: Apr. 17, 2000

(87) PCT Pub. No.: WO99/20399

PCT Pub. Date: Apr. 29, 1999

(30) Foreign Application Priority Data

Oct. 17, 1997 (AU) ..... PO 9875

(51) Int. Cl.[7] ..... F23D 11/10; F23D 11/40; F23D 14/62

(52) U.S. Cl. ..... 239/419; 239/418; 239/419.5

(58) Field of Search ..... 239/419, 419.5, 239/418, 598, 401, 407, 413, 414, 415, 428.5, 429, 525, 526, 527, 366, 600

(56) References Cited

U.S. PATENT DOCUMENTS

| | | | | |
|---|---|---|---|---|
| 2,719,994 A | * | 10/1955 | Dorsey | 239/526 |
| 2,754,153 A | * | 7/1956 | Barthod | 239/526 |
| 5,176,327 A | * | 1/1993 | Petersen et al. | 239/525 |
| 5,271,564 A | * | 12/1993 | Smith | 239/525 |
| 5,385,304 A | * | 1/1995 | Haruch | 239/434 |
| 5,695,120 A | * | 12/1997 | Kingsford | 239/525 |

* cited by examiner

*Primary Examiner*—Henry C. Yuen
*Assistant Examiner*—Davis Hwu
(74) *Attorney, Agent, or Firm*—Hoffman, Wasson & Gitler

(57) ABSTRACT

A gun having a body with a barrel extending through it is disclosed. A nozzle is coupled to one end of the barrel and to which a hose may be connected. A valve is connected to an opposite end of the barrel and a sleeve with circumferentially space substantially longitudinally extending passages is present within the barrel and compressed air may be introduced into the barrel and cause to flow through the spaced passages such that when the valve is open the flow of compressed air causes fluid to flow through the barrel.

10 Claims, 3 Drawing Sheets

GUN

THIS INVENTION relates to a gun for producing a flow of high pressure fluid. In particular, the invention is concerned with a gun for flushing vehicle cooling systems.

BACKGROUND OF THE INVENTION

The invention will be described by way of example with reference to the use of the gun for flushing vehicle cooling systems. It should be appreciated that this is by way of example only, and the gun of the invention may also be used for other purposes.

Currently, flushing of vehicle cooling systems is carried out by first removing either the cap from such a system or one of the hoses from the radiator of the system, and then introducing water from a hose into the radiator. The hose typically is connected to a reticulated water supply. The water introduced in this way is not particularly effective in flushing the cooling system.

SUMMARY OF THE INVENTION

It is an object of the present invention to provide a gun which at least minimises the disadvantages referred to above.

According to one aspect, the invention provides a gun for producing a flow of high pressure fluid, the gun having a gun body with a grip and a barrel, a passage extending completely extending completely through the barrel from one end of the barrel to the other end of the barrel and a nozzle coupling at one end of the barrel and a valve at the other end of the barrel to which a hose for delivering fluid to the gun may be attached to allow the fluid to be introduced into the barrel through the other end of the barrel, an inlet into the gun body for compressed air or fluid, a sleeve in the barrel between the ends of the barrel in which the fluid introduced through the other end and the compressed air are mixed and through which the mixed fluids may pass to cause the mixed fluids to be ejected out through the nozzle and the valve being operable between two positions for allowing fluid from the hose into the passage and for preventing fluid from the hose from flowing into the passage.

The inlet for compressed air may preferably be in the grip. A control valve may be located on the grip for controlling the flow of compressed air into the body of the gun.

The gun may include a sleeve within the barrel for imparting spiral motion to the compressed air. The sleeve may be oriented within the barrel to direct the air to that end of the barrel spaced from the end at which the fluid is introduced.

The sleeve may have passages extending through it at an inclined angle to a longitudinal axis extending along the barrel.

DESCRIPTION OF THE DRAWINGS

A particular preferred invention will now be described by way of example with reference to the drawings in which.

DETAILED DESCRIPTION OF THE PREFERRED EMBODIMENTS

Figure 1:
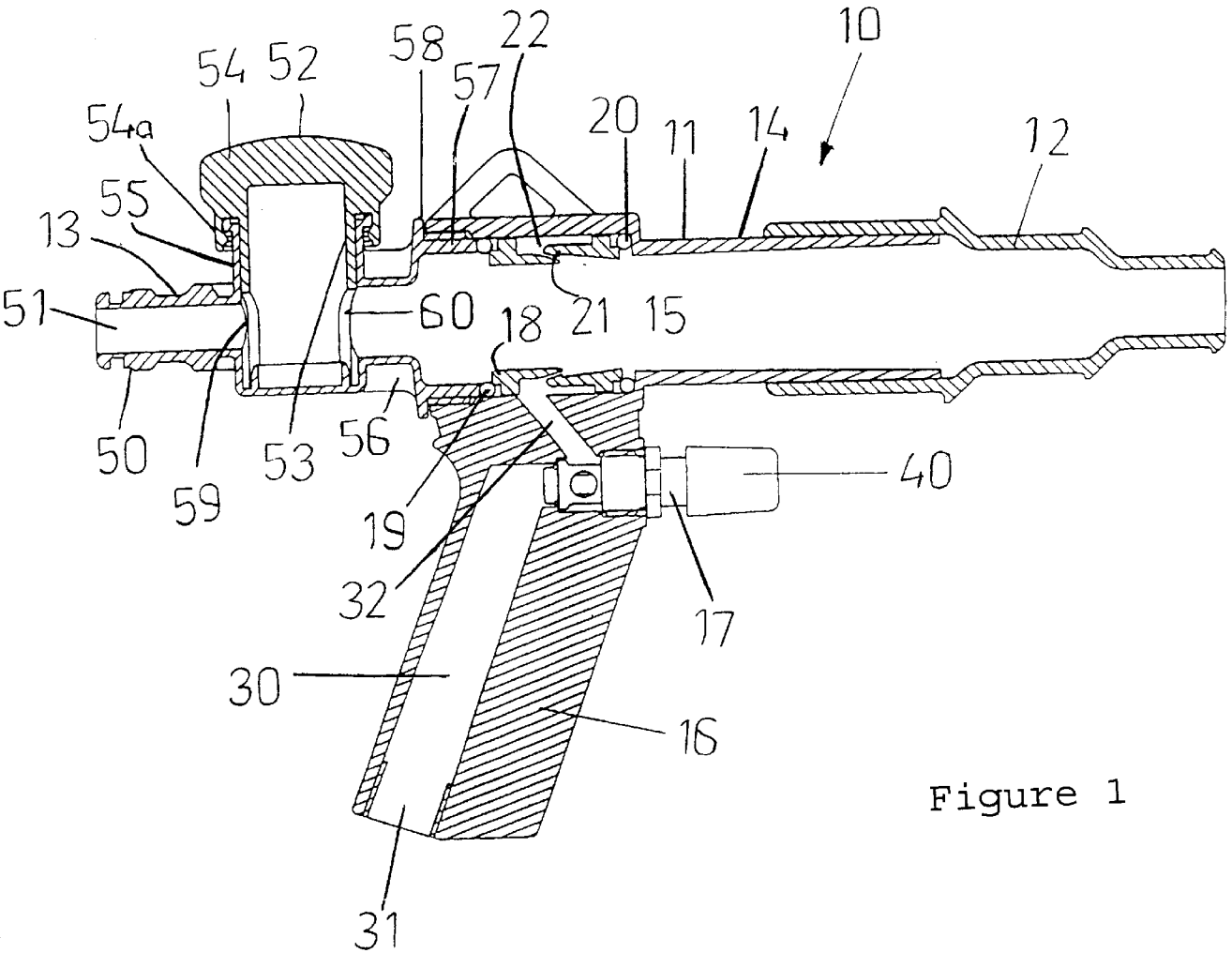
FIG. 1 is a longitudinal sectional view of a gun according to one embodiment of the invention.

In FIG. 1 a gun 10 for flushing vehicle cooling systems is shown in longitudinal cross section. The gun 10 has a gun body 11 a nozzle coupling 12 and an attachment coupling 13.

The gun body 11 has a barrel 14 with a through bore 15, a hand grip 16 and an operating trigger 17. The bore 15 has a sleeve 18 mounted within it between two seals 19, 20. The sleeve 18 has a plurality of passages 21 extending from an annular space 22 and communicating with bore 15. The passages 21 extend through the sleeve 18 and along it at an angle inclined to an axis extending longitudinally of the barrel 11. In addition, the passages extend at an inclined angle relative to an axis extending at right angles to the longitudinal axis. Thus, fluid passing through the passages 21 imparts a spiral motion to air or liquid within the bore 15. The passages 21 are located at circumferential locations around the sleeve 18.

The grip 16 has a passage 30 extending along it with an inlet 31 at one end of the grip 16. Compressed air may be introduced into passage 30 via inlet 31. Passage 30 communicates with the annular space 22.

The trigger 17 has a control button 40 which is on when depressed and off when released.

Nozzle coupling 12 has a stepped outer periphery to allow hose (not shown) of a variety of internal diameters to be connected to the flushing gun 10 of the embodiment of the invention. A hose clamp or clip (not shown) may be used to fix the hose to the nozzle coupling. The nozzle coupling also acts to concentrate the flow of fluid through the bore 15 into a high pressure stream of fluid. The nozzle coupling 12 frictionally engages over the barrel 14.

The attachment coupling 13 has a nozzle 50 with a passage 51. A supply hose (not shown) for supplying fluid to the gun 10 may be connected to nozzle 50. A valve 52 is formed at one end of the coupling and has a valve body 53 and an operating handle 54. The operating handle 54 is provided at one end of the body 53 and has a skirt 54*a* which extends outside the valve housing 55. The valve housing 55 has an outlet nozzle 56 with a sleeve 57 screw threaded within an end of the barrel 11. The valve body 53 is substantially cylindrical and has diametrically opposed apertures 59, 60. The body 53 may be rotated relative to valve housing 55 from the position shown where apertures 59 and 60 allow passage 51 to communicate with bore 15 to a position where the apertures 59, 60 are out of alignment with the passage 51 and bore 15 so that communication between them is prevented.

In use, a source of compressed air may be coupled to inlet 31 and a supply hose may be coupled to nozzle 50 to allow water to be supplied to the gun. An outlet hose is connected to coupling 12 and that hose is directed into a vehicle cooling system. Button 40 is depressed to allow compressed air to pass from passage 30 to passage 32 and to pass through passages 21 into the bore 15. The air passing into the bore has a spiral motion and serves to draw water through nozzle 50 and through valve 52 when that valve is in its open position as shown. The compressed air serves to propel the water through the bore 15 under pressure and this water may then be directed into a vehicle cooling system to flush that system.

The apparatus of the invention provides a supply of water at a greater pressure than that which would be possible if the hose which is coupled to nozzle 50 were directly connected to the vehicle cooling system.

If desired, valve 52 may be removed from the gun and the sleeve 18 removed and reinserted but in a position reversed from that shown. That is, the sleeve 18 may be inserted but positioned with the outlets from the passages 21 angled rearwardly towards the valve 52, rather than as shown in the figure. With such a configuration, fluid may be drawn through the gun from the coupling 12 and directed out through nozzle 51.

The air entrained with the high pressure water assists in the flushing operation and makes cleaning of cooling systems more effective when using the gun of the invention.

Figure 2:
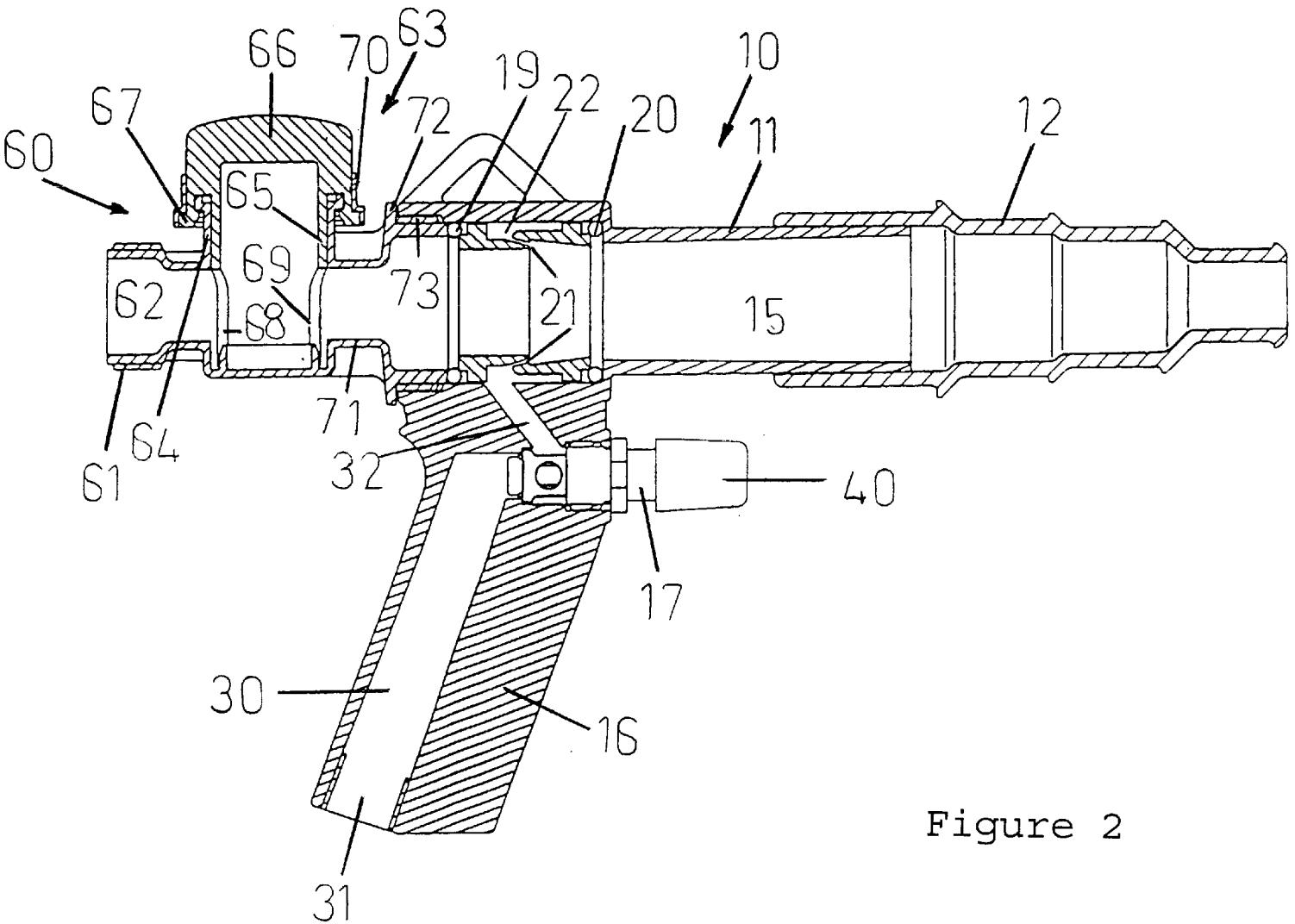
FIG. 2 is a longitudinal sectional view of a gun according to another embodiment of the invention.

FIG. 2 shows a longitudinal sectional view of a gun according to another embodiment of the invention. In this figure like parts to that shown in FIG. 1 are given the same reference numerals to that employed in FIG. 1.

In this embodiment, the gun 10 has a gun body 11, to which an attachment 60 of a different configuration to attachment 13 of FIG. 1 is attached.

Attachment 60 has a nozzle 61 to which a hose (not shown) may be attached. Nozzle 61 may have an end of the hose clamped or screw threaded to it whereas nozzle 50 in FIG. 1 is configured to receive a snap fitting connector (not shown). A passage 62 extends through the nozzle 61. A valve 63 is provided adjacent the nozzle 61 and valve housing 64 extends from an end of the nozzle 61: A valve body 65 is received within the housing 64.

An operating handle 66 is provided at one end of the body 65 and the handle has a skirt 67 which extends over the housing 64. The body has opposed apertures 68, 69 which may be brought into and out of alignment with passage 62 to when the valve is operated to allow passage 62 to communicate with passage 15. A collar 70 extends over the skirt 67.

Outlet nozzle 71 extends from the housing 64 and has a shoulder 72 and a screw threaded sleeve 73 which is received by an end of the body 11.

Figure 3:
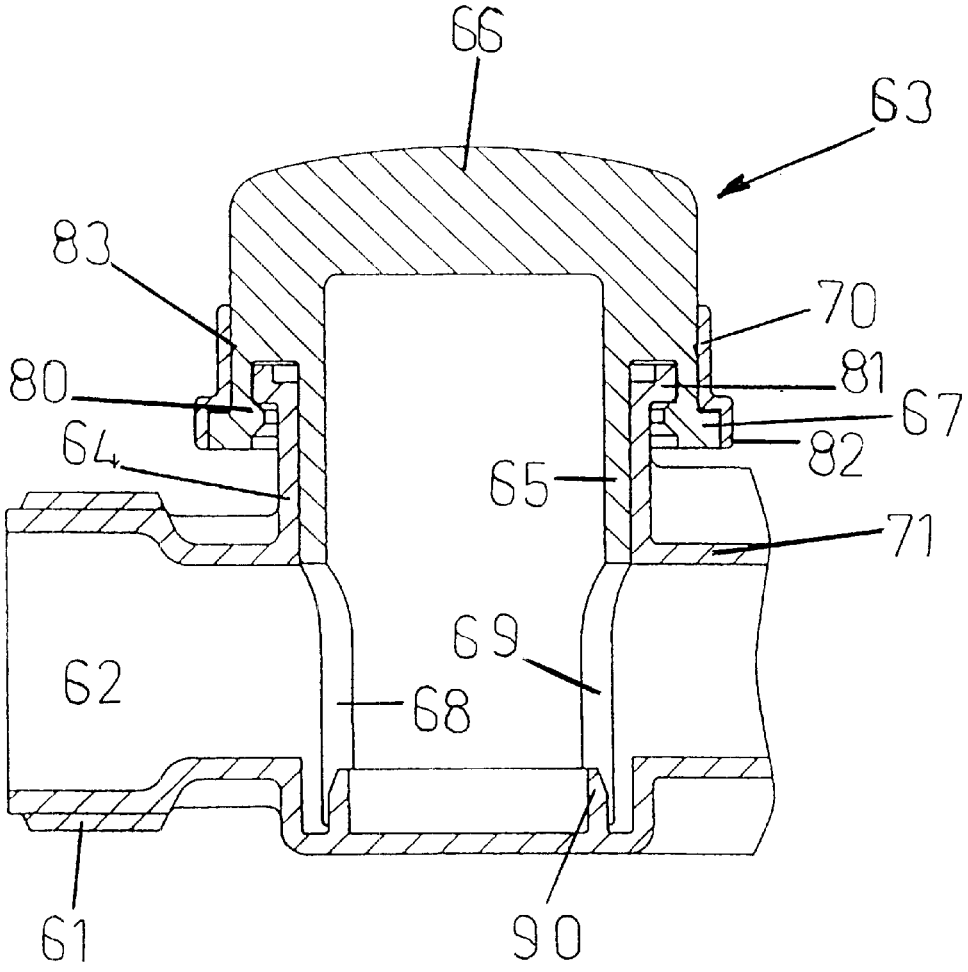
FIG. 3 is an enlarged sectional view of part of the gun of FIG. 2.

FIG. 3 shows greater detail of the nozzle 61, valve 63 and nozzle 71 shown in FIG. 2. The skirt 67 has an inwardly directed bead 80 and an end of the housing 64 has an outwardly directed lip 81. The bead 80 snaps over the lip 81 to ensure that the handle 66 and the body 65 are securely retained relative to the housing 64. The collar 70 has an enlarged lower end 82 which fits over the skirt 67 and functions to prevent the bead 80 from riding over the lip 81.

An upwardly directed spigot 90 extends upwardly within the passage 62 and a lower end of the valve body 65 locates about the spigot 90.

The handle 66, body 65 and skirt 67 may be made from a relatively soft plastics material to allow it to easily separate from a mould during its manufacture. The collar 70 may be made from a different and relatively rigid plastics material. A plurality of circumferentially spaced barbs 83 are present on an inner part of the collar and may bite into the skirt 67 to ensure that the collar does not easily separate from the handle after the collar is pressed into position.

What is claimed is:

1. A gun for producing a flow of high pressure fluid, the gun having a gun body with a grip and a barrel, said grip having a first passage extending through it for directing compressed air into the barrel, a control button for allowing the air to pass through said first passage in said grip, a second passage extending completely through the barrel from one end of the barrel to the other end of the barrel, a nozzle coupling at the one end of the barrel and a valve at the other end of the barrel to which a hose for delivering fluid to the gun may be attached, an inlet into the gun body for compressed air or fluid, a sleeve in the barrel between the ends of the barrel in which the fluid introduced through the other end and the compressed air are mixed and through which the mixed fluids may pass to cause the mixed fluids to be ejected out through the nozzle and the valve being operable between two positions for allowing fluid from the hose into the passage and for preventing fluid from the hose from flowing into the passage, said sleeve having circumferentially spaced passages extending through it with said first and said second passages extending along, and at an inclined angle, relative to the longitudinal axis extending along the barrel.

2. The gun of claim 1 wherein the passages also extend at an inclined angle relative to an axis extending at right angles to the longitudinal axis.

3. The gun of claim 1 wherein the sleeve is removably received within the barrel whereby the sleeve may be removed from and reinserted into the barrel in a reversed position.

4. The gun of claim 1 wherein the valve includes a first nozzle, to which a hose may be connected, a second nozzle connectable to the barrel and integrally formed valve housing, a valve body within the housing and a third passage extending through and between the nozzles of the valve.

5. The gun of claim 4 wherein the valve body has a handle for rotating the body to open and close the valve.

6. The gun of claim 5 wherein the handle has a skirt which extends over an end of the valve housing.

7. The gun of claim 6 wherein the skirt has an inwardly directed bead and the end of the housing has a lip against which the bead engages to resist separation of the handle from the housing.

8. The gun of claim 7 including a collar extending over the skirt.

9. The gun of claim 8 wherein the collar has an enlarged lower portion.

10. The gun of claim 8 wherein an inner surface of the collar has a plurality of spaced barbs which bite into the handle to attach the collar in its position relative to the handle.

* * * * *

UNITED STATES PATENT AND TRADEMARK OFFICE

CERTIFICATE OF CORRECTION

PATENT NO. : 6,386,465 B1
DATED : May 14, 2002
INVENTOR(S) : Mark Stephen Wilson It is certified that error appears in the above-identified patent and that said Letters Patent is hereby corrected as shown below:

Column 4,
Line 5, after “air”, insert -- or fluid --;
Line 6, change “air” to -- compressed air or fluid --;
Line 12, insert -- said --, prior to “compressed air”;
Line 14, after “air”, insert -- or fluid --;
Lines 17 and 18, before “passage”, insert -- second --;
Line 20, change “first and said second” to -- spaced --; delete the comma(,);
Line 21, delete the comma (,); change “the” to -- a --;
Line 24, insert -- spaced --, before “passages”; and
Line 32, change “a hose may be connected” to -- the hose may be attached --.

Signed and Sealed this

Twenty-ninth Day of October, 2002

*Attest:*

*Attesting Officer*

JAMES E. ROGAN
*Director of the United States Patent and Trademark Office*